US012643643B2

(12) United States Patent
Obas

(10) Patent No.: US 12,643,643 B2
(45) Date of Patent: Jun. 2, 2026

(54) PERSONAL EMERGENCY ALERT ASSEMBLY FOR DROWNING

(71) Applicant: Jacques Obas, Inwood, NY (US)

(72) Inventor: Jacques Obas, Inwood, NY (US)

( * ) Notice: Subject to any disclaimer, the term of this patent is extended or adjusted under 35 U.S.C. 154(b) by 447 days.

(21) Appl. No.: 18/195,226

(22) Filed: May 9, 2023

(65) Prior Publication Data

US 2024/0375756 A1 Nov. 14, 2024

(51) Int. Cl.
*B63C 9/20* (2006.01)
*B63C 9/15* (2006.01)
*B63C 9/18* (2006.01)

(52) U.S. Cl.
CPC ..... *B63C 9/20* (2013.01); *B63C 9/155* (2013.01); *B63C 9/18* (2013.01)

(58) Field of Classification Search
CPC ..... B63C 9/18; B63C 9/20; B63C 9/155
See application file for complete search history.

(56) References Cited

U.S. PATENT DOCUMENTS 1,289,123 A * 12/1918 Decowski ..... B63C 9/115 441/106
2,936,541 A * 5/1960 Stanford ..... A01K 97/01 116/281
4,586,456 A * 5/1986 Forward ..... B64B 1/40 244/33
4,807,557 A * 2/1989 Lodisio ..... G08B 5/02 116/281
5,030,153 A * 7/1991 Bailey ..... B63C 9/115 441/106
5,536,191 A * 7/1996 Lin ..... G08B 5/002 441/89
5,954,556 A * 9/1999 Powers ..... B63C 9/155 441/98
6,195,039 B1 * 2/2001 Glass, Jr. ..... B63C 9/21 441/89
6,368,174 B1 * 4/2002 Magee ..... B63C 9/20 441/89
6,551,159 B1 * 4/2003 Spinelli ..... B63C 9/00 441/89
6,688,253 B2 * 2/2004 Frink ..... B63C 11/26 116/210
7,104,858 B1 * 9/2006 Yonover ..... B63C 9/20 441/106
D745,101 S * 12/2015 Cottin ..... D21/805
9,273,937 B2 * 3/2016 Kang ..... B63C 9/20
9,284,028 B1 * 3/2016 Hoban ..... B63C 9/0005
9,666,062 B1 * 5/2017 Rachal ..... G08B 25/016
2004/0237178 A1 * 12/2004 Landeros ..... A62B 17/00 2/457
2007/0169681 A1 * 7/2007 Boyd ..... G09F 21/02 116/173

FOREIGN PATENT DOCUMENTS

WO WO0073143 7/2000

* cited by examiner

*Primary Examiner* — S. Joseph Morano
*Assistant Examiner* — Jovon E Hayes

(57) ABSTRACT

An emergency alert assembly for alerting people to a drowning or other emergency near an individual wearing the apparatus includes a belt and an alert device attached to the belt. The alert device includes a balloon and a gas tank which selectively fills the balloon with gas that is less dense than air. When filled with the gas, the balloon moves out of the housing and serves to indicate a location of an emergency such as a drowning.

9 Claims, 4 Drawing Sheets

(In Use View)

PERSONAL EMERGENCY ALERT ASSEMBLY FOR DROWNING

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to emergency alert apparatus and more particularly pertains to a new emergency alert apparatus for alerting people to a drowning or other emergency near an individual wearing the apparatus.

(2) Description of Related Art including information disclosed under 37 CFR 1.97 and 1.98

The prior art includes myriad examples of emergency alert apparatuses, including one device which attaches via a belt to a user and which is capable of filling a balloon having visual components with gas so that the balloon floats in the air and draws attention to the user. However, this device and others in the prior art fail to disclose an emergency alert device that includes structure to allow for automatic release of a balloon from a housing upon filling the balloon with a gas. Such a device would be desirable, because it would allow for more immediate release of the component which alerts viewers to an emergency.

BRIEF SUMMARY OF THE INVENTION

An embodiment of the disclosure meets the needs presented above by generally comprising a belt with a size such that the belt is configured to be worn around a waist of a user. An alert device is coupled to the belt which comprises a housing, a gas tank, a quantity of gas, a tubing, a balloon, and a valve. The housing has an outer wall enclosing an interior space and an opening extending through the outer wall to the interior space. The gas tank is coupled to the housing and is positioned in the interior space. The quantity of gas is contained in the gas tank under pressure. The tubing is fluidly coupled to the gas tank and is positioned in the housing. The balloon is fluidly coupled to a distal end of the tubing with respect to the gas tank and is positioned in the housing adjacent to the opening.

The balloon comprises a stretchable material such that the balloon expands when the balloon is filled with the gas. The balloon moves outwardly of the interior space through the opening when the balloon expands by pressing against the housing or other components within the interior space. The valve is coupled to the gas tank and prevents the gas from moving from the gas tank to the tubing when the valve is in a closed condition. The valve is actuatable to an open condition to release the gas from the gas tank such that the gas moves through the tubing and into the balloon.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
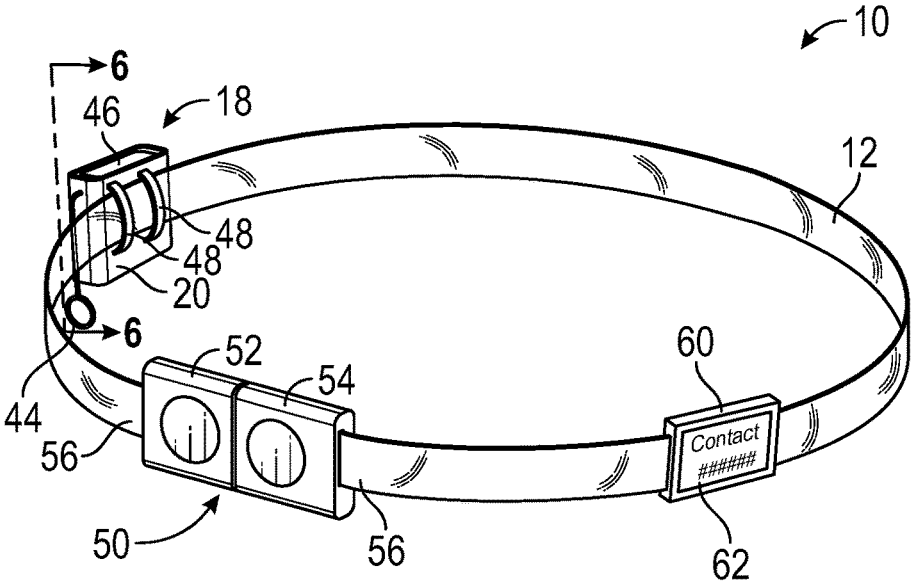
FIG. 1 is a perspective view of an emergency alert assembly according to an embodiment of the disclosure.
Figure 2:
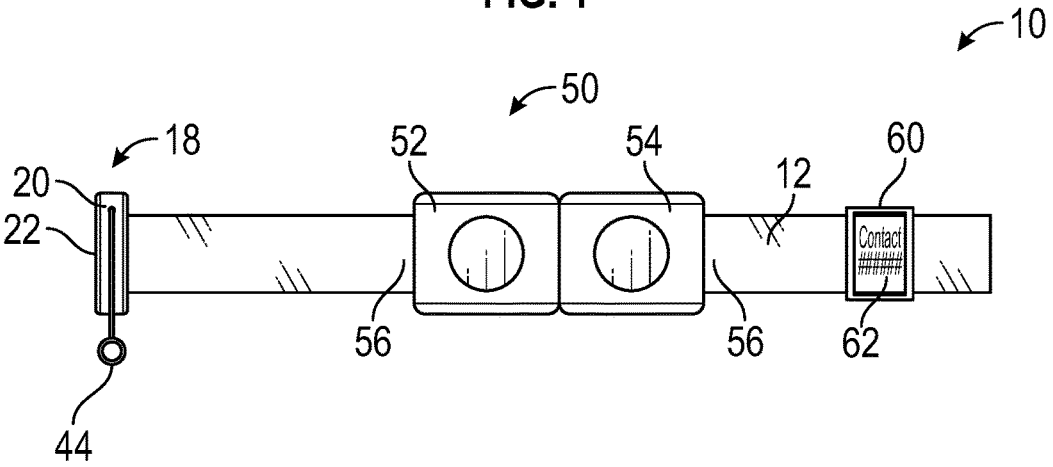
FIG. 2 is a front view of an embodiment of the disclosure.
Figure 3:
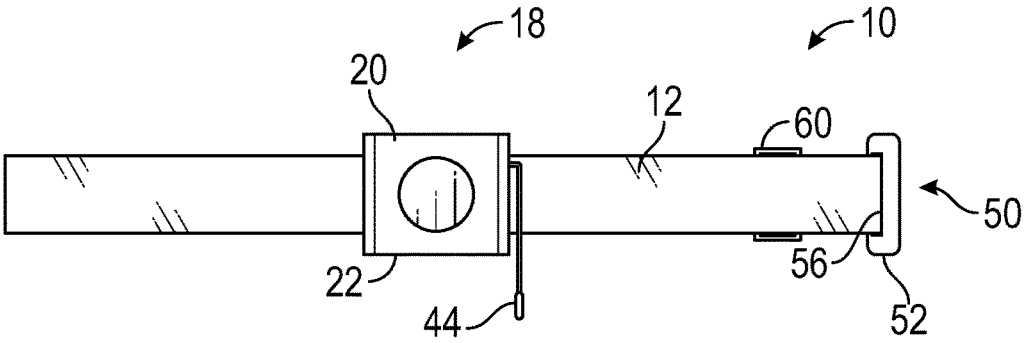
FIG. 3 is a side view of an embodiment of the disclosure.
Figure 4:
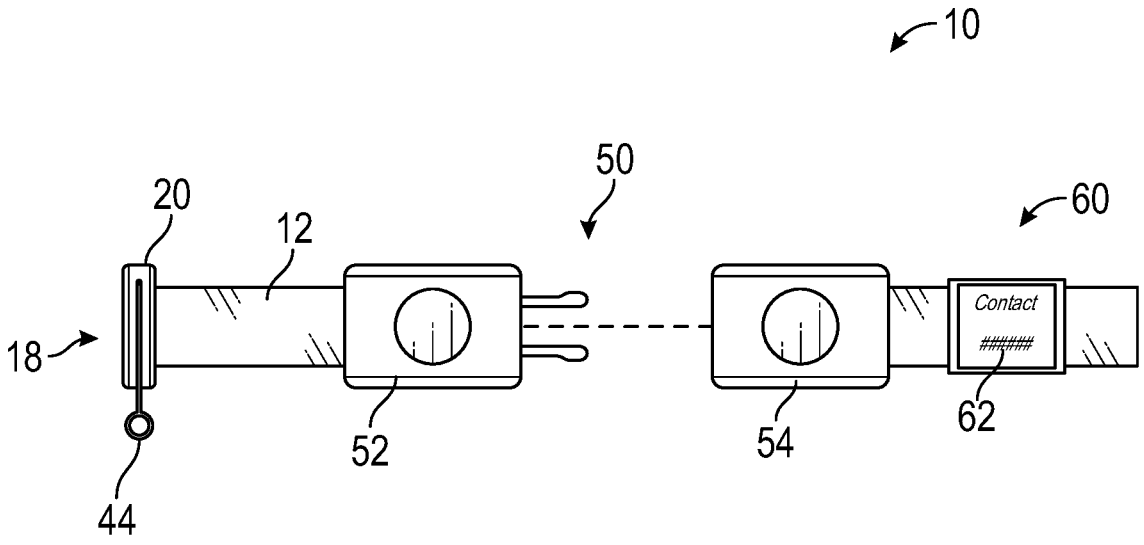
FIG. 4 is a front view of an embodiment of the disclosure.
Figure 5:
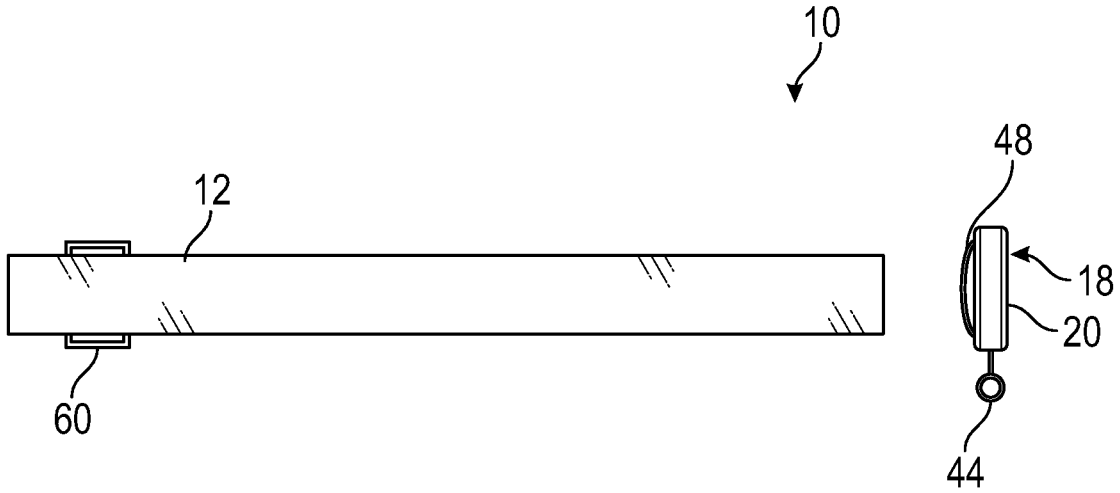
FIG. 5 is an exploded back view of an embodiment of the disclosure.
Figure 6:
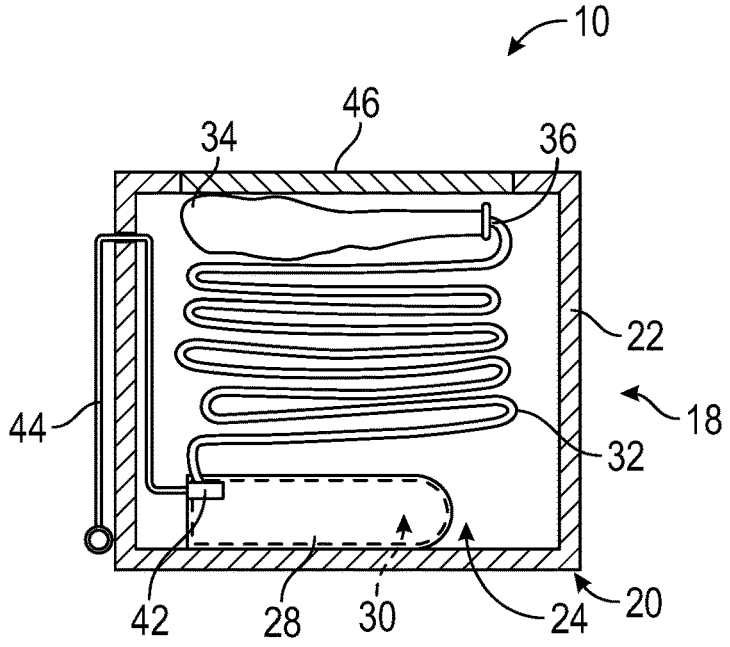
FIG. 6 is a cross-sectional view of an alert device of an embodiment of the disclosure taken from Arrows 6-6 in FIG. 1.
Figure 7:
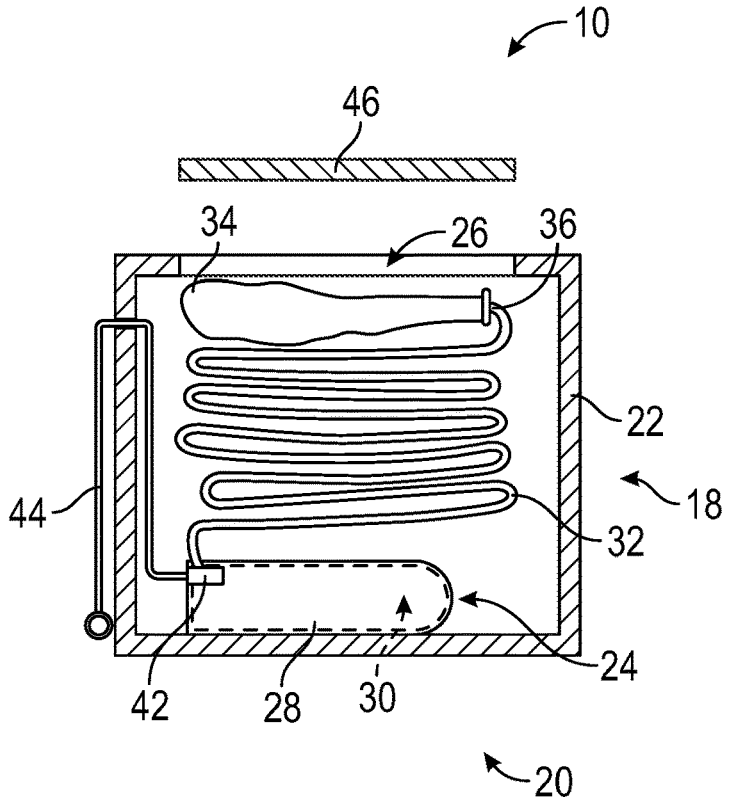
FIG. 7 is an exploded cross-sectional view of an alert device of an embodiment of the disclosure taken from Arrows 6-6 in FIG. 1.
Figure 8:
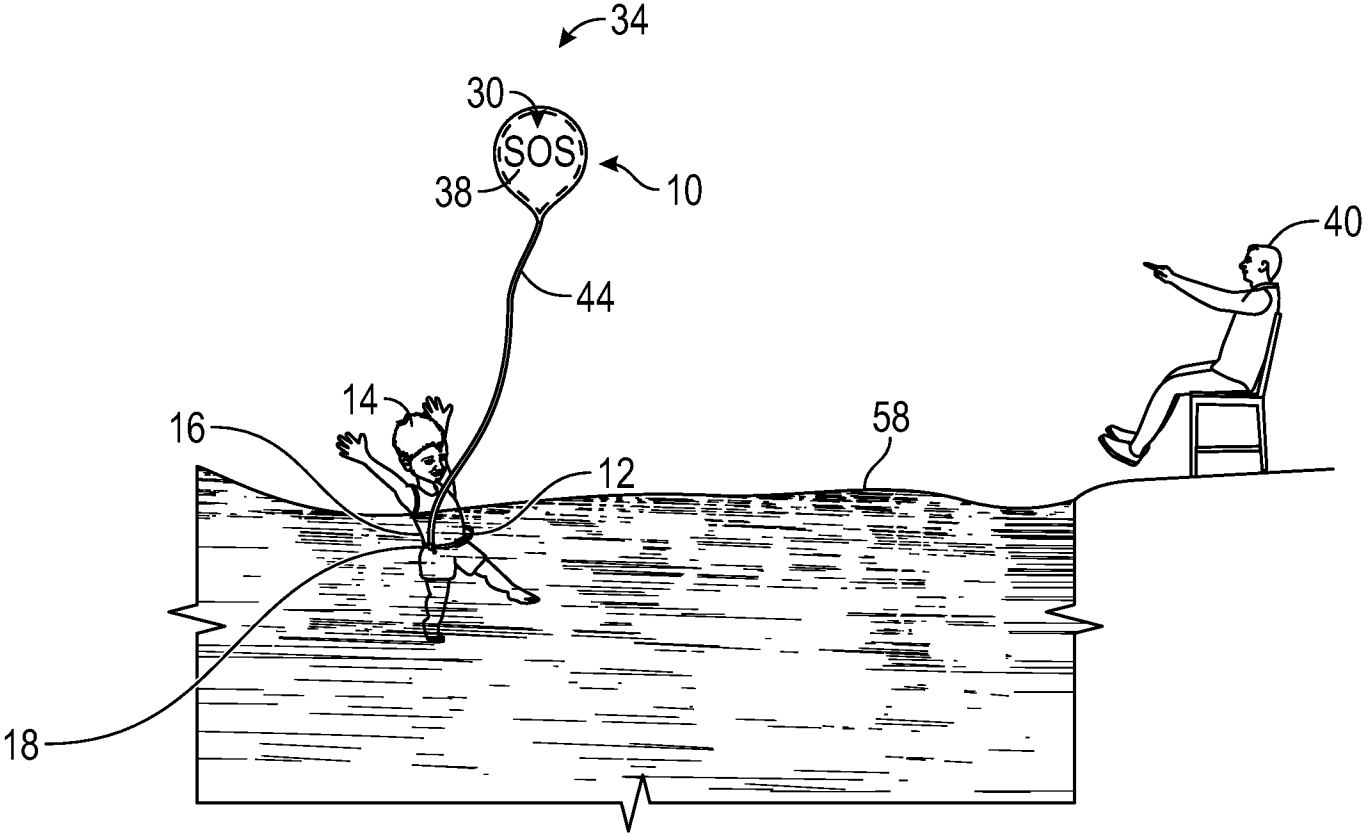
FIG. 8 is an in-use view of an embodiment of the disclosure.

With reference now to the drawings, and in particular to FIGS. 1 through 8 thereof, a new emergency alert apparatus embodying the principles and concepts of an embodiment of the disclosure and generally designated by the reference numeral 10 will be described.

As best illustrated in FIGS. 1 through 8, the emergency alert assembly 10 generally comprises a belt 12 with a size such that the belt 12 is configured to be worn around a waist 16 of a user 14. The belt 12 is translucent such that the belt 12 is obscured from view. An alert device 18 is coupled to the belt 12 and is detachable from the belt 12 so that the alert device 18 is replaceable with other alert devices 18. A badge 60 is coupled to the belt 12 which includes indicia 62 comprising emergency contact information such as a phone number. The badge's 60 indicia 62 may also include information relating to a medical condition of the user 14 or the like.

The alert device 18 comprises a housing 20 with an outer wall 22 that encloses an interior space 24 and an opening 26 that extends through the outer wall 22 to the interior space 24. A gas tank 28 is coupled to the housing 20 and is positioned in the interior space 24. A quantity of gas 30 is contained in the gas tank 28 under pressure. The gas 30 comprises helium but may comprise any gaseous material which has a density less than a density of the air present around the emergency alert assembly 10 during use. A tubing 32 is fluidly coupled to the gas tank 28 and is positioned in the housing 20. The tubing 32 has a length such that the tubing 32 is positionable to extend upwardly from the waist 16 of the user 14 to above the user 14.

The alert device 18 further comprises a balloon 34 is fluidly coupled to a distal end 36 of the tubing 32 with respect to the gas tank 28 and is positioned in the housing 20 adjacent to the opening 26. The balloon 34 comprises a stretchable material such that the balloon 34 expands when the balloon 34 is filled with the gas 30. The balloon 34 moves outwardly of the interior space 24 through the opening 26 when the balloon 34 expands by pressing against the housing 20 or other elements in the interior space 24 of the housing 20. The housing 20 may have specially shaped interior surfaces positioned opposite the opening 26 across the balloon 34 to enable outward movement of the balloon 34 with respect to the housing 20. An alert indicia 38 is coupled to an exterior of the balloon 34 and comprises an alert message to alert observers 40 of an emergency. The alert message may include a textual message, a graphical image, a color, a symbol, or the like.

The alert device 18 also includes a valve 42 that is coupled to the gas tank 28 and prevents the gas 30 from moving from the gas tank 28 to the tubing 32 when the valve 42 is in a closed condition. The valve 42 is actuatable to an open condition to release the gas 30 from the gas tank 28 such that the gas 30 moves through the tubing 32 and into the balloon 34. A pull cord 44 is attached to the valve 42 and is pulled to actuate the valve 42 to the open condition. The pull cord 44 extends through the outer wall 22 of the housing 20 so that the user 14 may pull the pull cord 44 from without the housing 20. A seal 46 is coupled to the housing 20 and covers the opening 26. The balloon 34 urges at least a portion of the seal 46 to move relative to the housing 20 when the balloon 34 expands such that the balloon 34 is able to move outwardly of the interior space 24. For example, the seal 46 may be temporarily bonded to the housing 20 such that the balloon 34 detaches the seal 46 from the housing 20. In other embodiments, the seal 46 may be formed of a material which fractures under the force exerted by the balloon 34 as it expands. In yet other embodiments, the seal 46 may comprise a biased door which opens when the balloon 34 inflates.

The alert device 18 also has at least one attachment loop 48 coupled to the housing 20 and extending around the belt 12. The at least one attachment loop 48 slidably couples the housing 20 to the belt 12. A buckle 50 is coupled to the belt 12 and releasably couples a pair of ends 56 of the belt 12. The buckle 50 has a male member 52 and a female member 54. The alert device 18 is slidably removable from the belt 12 when the buckle 50 is uncoupled. The alert device 18 is also slidable to be positionable in any of a plurality of selected positions along the belt 12. In other embodiments, the alert device 18 is releasably couplable to the belt 12 via a hook-and-loop fastener, a latch, a clip, or the like.

In use, the belt 12 is positioned around the waist 16 of the user 14. If the user 14 is experiencing an emergency while in a body of water 58, such as drowning, experiencing a medical event, or the like, the user 14 pulls the pull cord 44 to inflate the balloon 34, which moves outwardly of the housing 20 and lifts above the user 14 due to the density of the gas 30. The alert indicia 38 alerts observers 40 of the emergency. After use, the alert device 18 may be replaced by another alert device 18. The tubing 32 also tethers the balloon 34 to the housing 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An emergency alert assembly comprising:

a belt having a size such that the belt is configured to be worn around a waist of a user; and an alert device being coupled to the belt, the alert device comprising:

a housing having an outer wall enclosing an interior space, the housing having an opening extending through the outer wall to the interior space;

a gas tank being coupled to the housing and being positioned in the interior space;

a quantity of gas being contained in the gas tank under pressure;

a tubing being fluidly coupled to the gas tank and being positioned in the housing;

a balloon being fluidly coupled to a distal end of the tubing with respect to the gas tank and being positioned in the housing adjacent to the opening, the balloon comprising a stretchable material such that the balloon expands when the balloon is filled with the gas, the balloon moving outwardly of the interior space through the opening when the balloon expands; and a valve being coupled to the gas tank and preventing the gas from moving from the gas tank to the tubing when the valve is in a closed condition, the valve being actuatable to an open condition to release the gas from the gas tank such that the gas moves through the tubing and into the balloon; and wherein the tubing has a length such that the tubing is configured to be positionable to extend upwardly from the waist of the user to above the user such that the balloon is configured to float above the user indicating a position of the user.

2. The assembly of claim 1, wherein the alert device is detachable from the belt.

3. The assembly of claim 2, wherein the alert device further comprises at least one attachment loop being coupled to the housing and extending around the belt, the at least one attachment loop slidably coupling the housing to the belt, the emergency alert assembly further comprising a buckle being coupled to the belt and releasably coupling a pair of ends of the belt, the buckle having a male member and a female member, wherein the alert device is slidably removable from the belt when the buckle is uncoupled.

4. The assembly of claim 1, wherein the belt is translucent such that the belt is obscured from view.

5. The assembly of claim 1, wherein the gas comprises helium.

6. The assembly of claim 1, wherein the alert device further comprises a pull cord being attached to the valve and being pulled to actuate the valve to the open condition, the pull cord extending through the outer wall of the housing.

7. The assembly of claim 1, wherein the alert device further comprises a seal being coupled to the housing and covering the opening, the balloon urging at least a portion of the seal to move relative to the housing when the balloon expands such that the balloon is able to move outwardly of the interior space.

8. The assembly of claim 1, wherein the alert device further comprises an alert indicia being coupled to an exterior of the balloon, the alert indicia comprising an alert message.

9. An emergency alert assembly comprising:

a belt having a size such that the belt is configured to be worn around a waist of a user, the belt being translucent such that the belt is obscured from view;

an alert device being coupled to the belt, the alert device being detachable from the belt, the alert device comprising:

a housing having an outer wall enclosing an interior space, the housing having an opening extending through the outer wall to the interior space;

a gas tank being coupled to the housing and being positioned in the interior space;

a quantity of gas being contained in the gas tank under pressure, the gas comprising helium;

a tubing being fluidly coupled to the gas tank and being positioned in the housing;

a balloon being fluidly coupled to a distal end of the tubing with respect to the gas tank and being positioned in the housing adjacent to the opening, the balloon comprising a stretchable material such that the balloon expands when the balloon is filled with the gas, the balloon moving outwardly of the interior space through the opening when the balloon expands;

a valve being coupled to the gas tank and preventing the gas from moving from the gas tank to the tubing when the valve is in a closed condition, the valve being actuatable to an open condition to release the gas from the gas tank such that the gas moves through the tubing and into the balloon;

a pull cord being attached to the valve and being pulled to actuate the valve to the open condition, the pull cord extending through the outer wall of the housing;

a seal being coupled to the housing and covering the opening, the balloon urging at least a portion of the seal to move relative to the housing when the balloon expands such that the balloon is able to move outwardly of the interior space;

an alert indicia being coupled to an exterior of the balloon, the alert indicia comprising an alert message; and at least one attachment loop being coupled to the housing and extending around the belt, the at least one attachment loop slidably coupling the housing to the belt;

a buckle being coupled to the belt and releasably coupling a pair of ends of the belt, the buckle having a male member and a female member, wherein the alert device is slidably removable from the belt when the buckle is uncoupled; and wherein the tubing has a length such that the tubing is configured to be positionable to extend upwardly from the waist of the user to above the user such that the balloon is configured to float above the user indicating a position of the user.

* * * * *